US005697487A

United States Patent [19]

Engelke et al.

[11] Patent Number: 5,697,487

[45] Date of Patent: Dec. 16, 1997

[54] PALLET FOR A PASSENGER CONVEYOR

[75] Inventors: Bernward Engelke; Jörg Ostermeier; Peter Borchers, all of Stadthagen, Germany

[73] Assignee: Otis Elevator Company, Farmington, Conn.

[21] Appl. No.: 550,975

[22] Filed: Oct. 31, 1995

[51] Int. Cl.[6] ..... B66B 23/12

[52] U.S. Cl. ..... 198/333; 198/326

[58] Field of Search ..... 198/321, 326, 198/327, 333

[56] References Cited

U.S. PATENT DOCUMENTS

| | | | |
|---|---|---|---|
| 3,191,743 | 6/1965 | Rissler et al. | 198/16 |
| 3,247,947 | 4/1966 | Fox et al. | 198/16 |
| 3,513,780 | 5/1970 | Jenkins | 104/25 |
| 3,530,799 | 9/1970 | Braun | 104/25 |
| 4,154,336 | 5/1979 | Sorokin | 198/864 |
| 4,170,281 | 10/1979 | Lapeyre | 198/844 |
| 4,244,457 | 1/1981 | Ernst | 198/321 |
| 4,276,976 | 7/1981 | Dunstan et al. | 198/334 |
| 4,295,556 | 10/1981 | Saito et al. | 198/325 |
| 4,645,059 | 2/1987 | Hofling et al. | 198/321 |
| 5,072,821 | 12/1991 | Kruse et al. | 198/333 X |

FOREIGN PATENT DOCUMENTS

| | | | |
|---|---|---|---|
| 3337611 | 12/1985 | Germany | B66B 23/10 |
| 4201979 | 7/1992 | Japan | 198/333 |
| 0510029 | 7/1939 | United Kingdom | 198/326 |

*Primary Examiner*—James R. Bidwell

[57] ABSTRACT

A pallet for a passenger conveyor includes an integrally formed thin walled support frame. The support frame walls all extend in the same principle direction to permit the support flame to be formed by an extrusion process. In a particular embodiment, the support frame includes thin walls extending in the width dimension. In another embodiment, the support frame includes multiple, integrally formed pieces having thin walls extending in the length dimension. The width of the support frame is dependent on the combined width of the multiple pieces.

20 Claims, 3 Drawing Sheets

PALLET FOR A PASSENGER CONVEYOR

TECHNICAL FIELD

This invention relates to passenger conveyors, and more particularly to pallets for such passenger conveyors.

BACKGROUND OF THE INVENTION

Passenger conveyors, such as escalators and moving walks, are well known and efficient devices for transporting people. Escalators are typically used to transport people vertically, such as from one floor of a building to another, and moving walks am more commonly used to transport people horizontally from one point to another in a linear fashion. The length and width of the conveyor is selected depending upon the passenger traffic of the particular application.

One type of moving walk is comprised of a truss, a drive sprocket, an idler sprocket, a pair of pallet chains, and a plurality of pallets extending sequentially between and attached to the pallet chains. The drive sprocket engages the pallet chains to drive them through a continuous loop that includes the idler sprocket at the opposite end. The pallet chain includes sequentially coupled chain links and a plurality of rollers that ride in a pair of roller tracks.

A typical pallet is formed by a die casting process. This process provides the dimensional consistency required while minimizing the fabrication costs for a particular pallet type. Each different size pallet, however, requires a different casting mold. To provide a passenger conveyor having a selection of conveyor widths to use in variety of applications requires a plurality of casting molds be available. Increasing the selection of widths available increases the overall cost of fabrication of the passenger conveyor.

The above art notwithstanding, scientists and engineers under the direction of Applicant's Assignee are working to develop passenger conveyors having minimal fabrication costs.

DISCLOSURE OF THE INVENTION

According to the present invention, a pallet for a passenger conveyor includes a support structure having a plurality of integrally formed, thin walls forming a profile with all the walls extending in the same principle direction.

The feature of the thin walled profile permits the pallet to be easily and inexpensively fabricated using an extrusion process. Further, this configuration permits the pallet to be fabricated to different widths simply by cutting the extruded profiles to the desired width. The costly requirement of having different casting molds for the various size pallets, as known in the prior art pallet formed by die casting, can thereby be avoided.

According to a particular embodiment of the present invention, the pallet is extruded along its length dimension, measured parallel with the direction of travel of the conveyor, and includes a plurality of mating pieces. The mating pieces may be interchanged to form pallets of variable widths as desired.

The multiple piece pallet provides the flexibility in width dimension of the conveyor with a minimal number of extruded parts. In combination with forming the pallet pieces by extrusion along the length dimension, which permits flexibility in the length dimension of the pallet as described above, this particular embodiment results in a cost efficient pallet for a variety of length and width dimensions.

"Pallet" as used herein is defined to include all varieties of treadplates and support structures for passenger conveyors, including both moving walk pallets and escalator steps.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
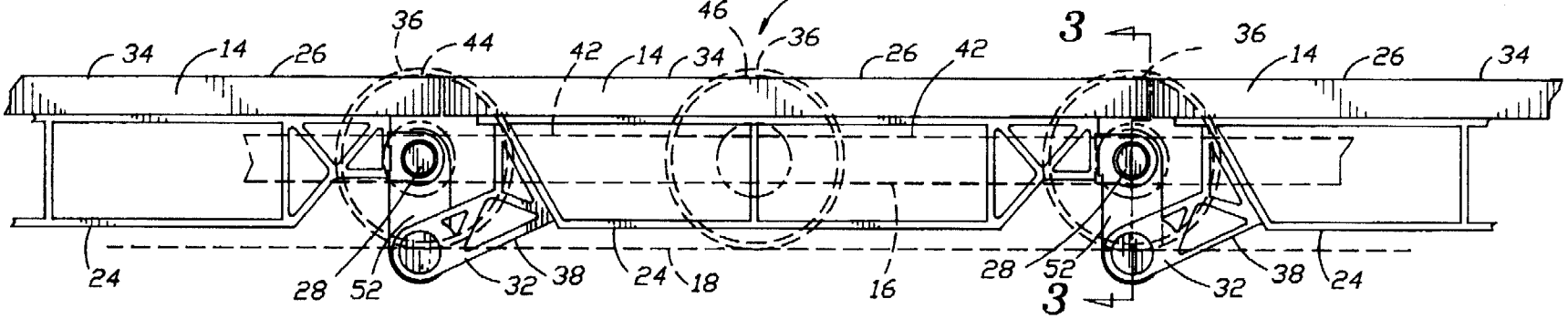
FIG. 1 is a side view of adjacent pallets with a pallet chain, rollers and roller track shown in dashed lines.

A pallet assembly 12 for a passenger conveyor is illustrated in FIG. 1. The pallet assembly 12 includes a plurality of sequentially connected pallets 14, a pallet chain 16, and a roller track 18.

Each of the pallets 14 includes a support frame 24, a treadplate 26, a pair of roller axles 28, and a pair of pins 32. The support frame 24 provides a rigid structure to support the loads carried by the pallets 14 during operation. The treadplate 26 is attached to the support frame 24 and defines a surface 34 for the passengers riding the conveyor. The pair of roller axles 28 are disposed on the front edge of the pallet 14 and each is engaged with a roller 36. Each of the pins 32 is connected to the support frame 24 by an extension 38 projecting from the aft edge of the pallet 14.

The pallet chain 16 includes a plurality of the rollers 36 spaced apart and interconnected by a plurality of chain links 42. The plurality of rollers 36 includes puller rollers 44 and idler rollers 46. The puller rollers 44 are engaged with the roller axles 28 of the pallets 14. The idler rollers 46 are interspersed between adjacent puller rollers 44 and connected to opposing ends of adjacent chain links 42.

The roller track 18 extends along the length of the passenger conveyor 12 and defines a path for the plurality of rollers 36.

Adjacent pallets 14 are connected via a pair of links 52. Each link 52 is engaged with the roller axle 28 of one pallet 14 and the pin 32 of the adjacent pallet 14. The link 52 is permitted rotational motion about both the roller axle 28 and the pin 32.

Figure 2:
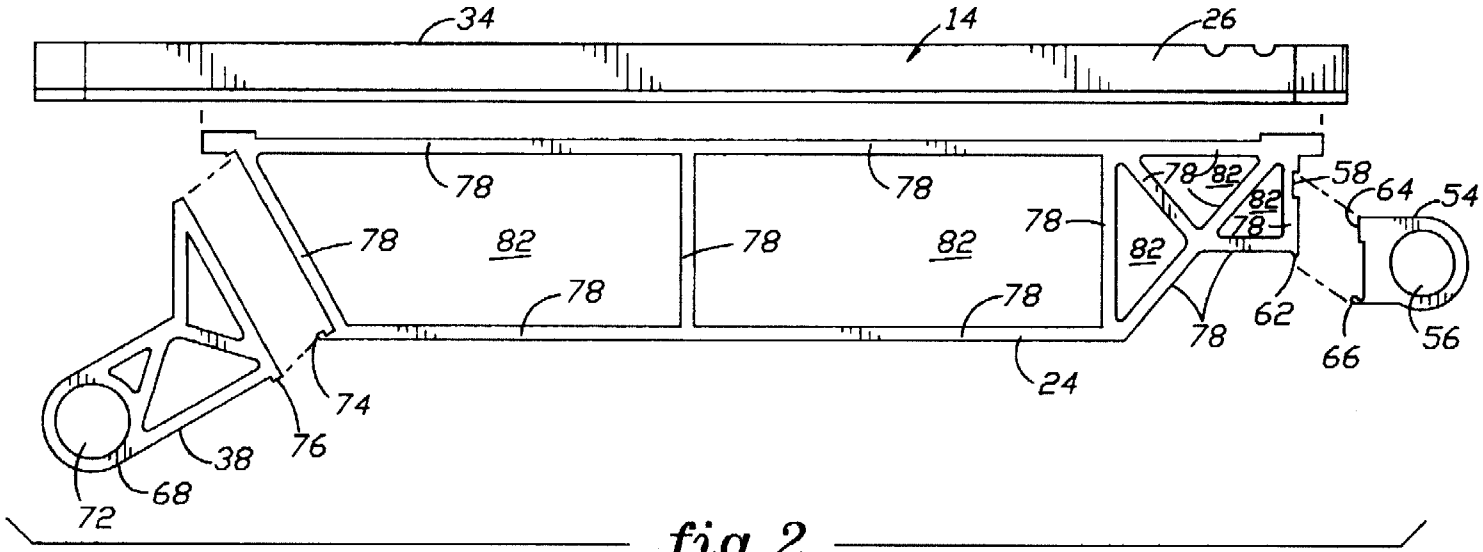
FIG. 2 is a side view of one of the pallets, exploded to show each of the individual parts.
Figure 3:
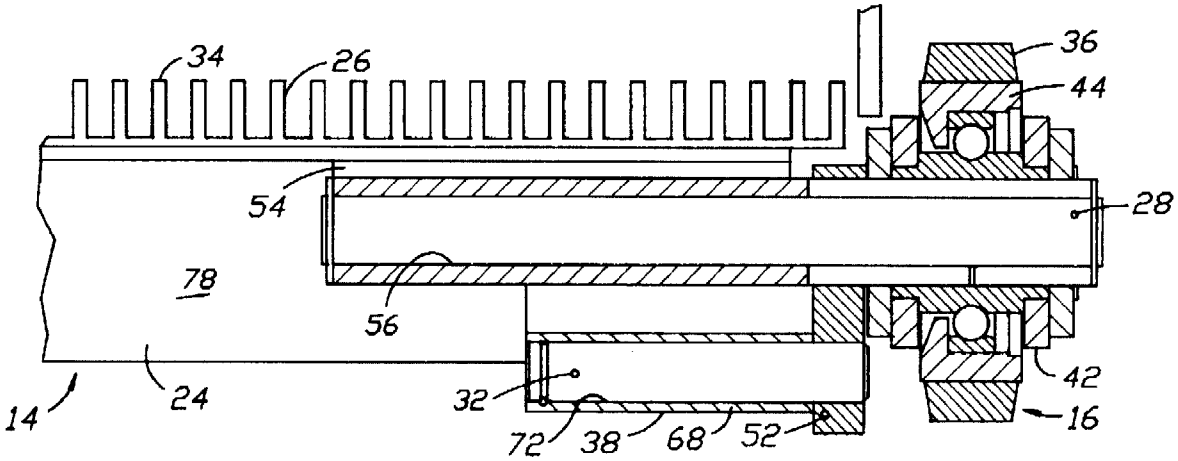
FIG. 3 is a view taken along line 3—3 of FIG. 1.

As shown in more detail in FIGS. 2 and 3, the pallet 14 includes the integrally formed support frame 24 having means to attach the axles 28 on the front edge of the support frame 24 with the pins 32 on the aft edge of an adjacent pallet support frame. For the axles 28, the attachment means is a pair of yokes 54 extending from the forward edge and having an aperture 56 for the axles 28 to fit within. The forward pair of yokes 54 are formed separately from the support frame 24 and are attached to the support frame 24 by bonding such as welding or other convenient means. The support frame 24 illustrated in FIG. 2 includes a groove 58 and a notch 62 and the forward yokes 54 include a tongue 64 and a hook 66. The tongue 64 is positioned and sized to fit within the groove 58 and the hook 66 is positioned and configured to engage the notch 62. The engagement of the tongue 64 and groove 58 and the engagement of the hook 66 and notch 62 facilitate the bonding of the forward yokes 54 to the support frame 24, such as by welding.

As shown in FIG. 3, each of the forward yokes 54 extends laterally across a portion of the forward edge of the pallet 14. Although this configuration is shown as an illustrative embodiment, it should be apparent to those skilled in the art that the pair of yokes may be replaced with a single yoke and axle extending the entire width of the forward edge. In this configuration, the single yoke could be formed integrally with the support frame.

For the pins 32, the attachment means is a second pair of yokes 68 disposed on the extensions 38 on the aft edge of the pallet 14. Each of the aft yokes 68 includes an aperture 72 for the pins 32 to fit within. The support frame 24 includes an aft hook 74 and the aft yokes 68 include a ridge 76 positioned and configured to engage the hook 74 to facilitate retention of the aft yokes 68 during the bonding process. As shown in FIG. 3, the aft yokes 68 and extensions 38 as illustrated do not extend the entire width of the pallet 14, although as discussed with respect to the forward yokes, a single, integral extension and yoke may be used without departing from the spirit and scope of the invention.

The treadplate 26 is formed separately from the support frame 24, as shown in FIG. 2, and is attached to the support frame 24 by bonding in a conventional manner. Having the treadplate 26 as a separate structure permits different style treadplates to be used with the same support frame, as the particular application requires. This configuration enhances the applicability of the support frame to different style pallet assemblies.

The support frame 24 is a hollow body construction having a plurality of integrally formed, interconnected thin wails 78 defining a plurality of hollow cavities 82. The hollow cavities 82 minimize the weight of the support frame 24. The thin walls 78 all have a principle direction of extension that, as illustrated in FIGS. 1–3, is perpendicular to the direction of travel of the pallet assembly 12. Having all the thin walls 78 extending in the same principle direction results in the ability to form the support frame 24 using an extrusion process.

The manufacture of the pallet 14 shown in FIGS. 1–3 is as follows. The treadplate 26 is formed in a conventional manner, such as by die casting, to the desired width. The support frame 24 is extruded along the width dimension and then cut to the same desired width as the treadplate 26. The forward and aft yokes 54,68 are formed and attached to the support frame 24 and the treadplate 26 is attached to the support frame 24. If additional types of pallet assemblies are required having different widths, the manufacture is similar except that the treadplates are formed to the desired dimension of that particular application and the same support frame configuration is extruded but cut to that particular width dimension. In this way, the same support frame configuration may be used for multiple applications having different pallet widths.

Figure 4A:
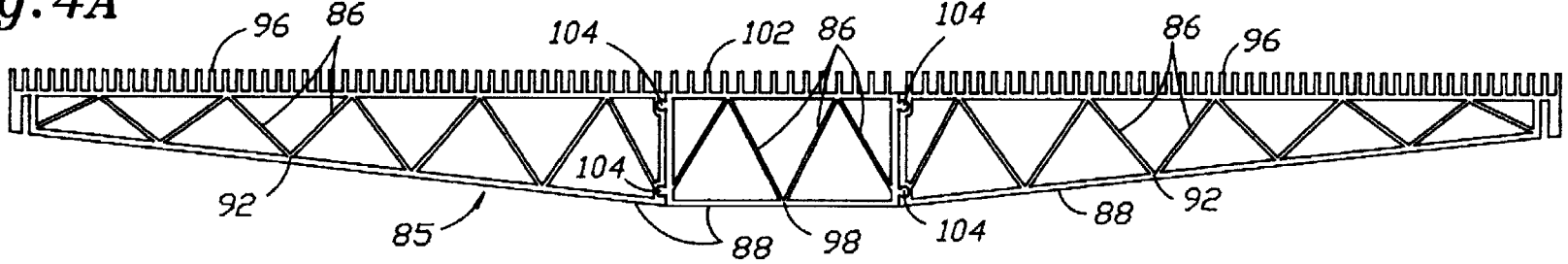
FIG. 4 is an end view of an alternate embodiment of the pallet according to the present invention.
Figure 4B:
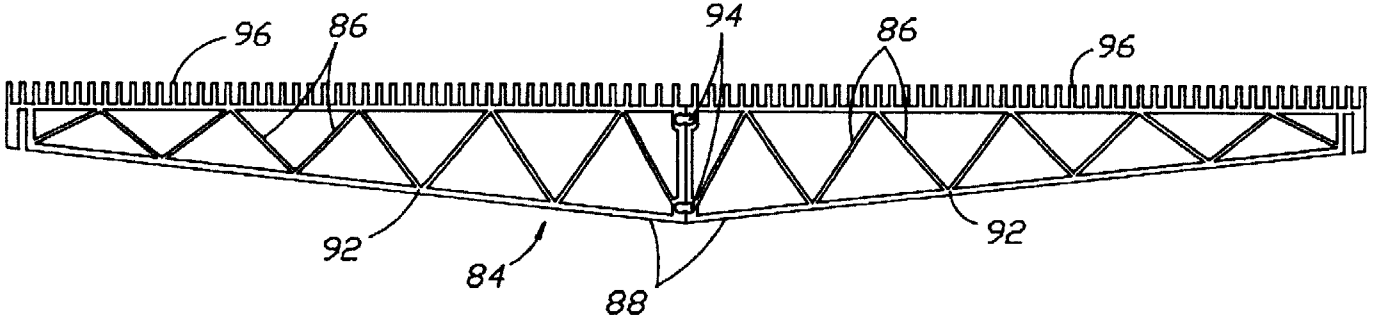

An alternate embodiment is illustrated in FIG. 4. Whereas the previous embodiment included thin walls extending along the width of the pallet, the embodiments of FIGS. 4a and 4b include a support frame 84 having integrally formed thin walls 86 extending along the length dimension. The support frame 84 is the combination of multiple support pieces 88, each integrally formed and then mated to define the support structure. In FIG. 4*a*, the support frame 84 is formed by two mating pieces 92 that are mirror images of each other and include fastener means 94 to attach the two pieces 92 together. The result is a support frame 84 having a width equal to twice the width of the individual pieces 92. A treadplate 96 is integrally formed with each of the pieces 92.

In FIG. 4*b*, the support frame 85 is formed by three pieces, including two of the mirror image pieces 92 as in FIG. 4*a* and a third center piece 98. The center piece 98 includes an integral treadplate 102 and integral fasteners 104 that engage the two mirror image pieces 92 to form the pallet. The result in this configuration is a support frame 85 having a width equal to the combined widths of the two minor image pieces 92 and the center piece 98. Although not shown in the figures, additional pieces may be used to produce pallets of varying widths as desired.

Figure 5:
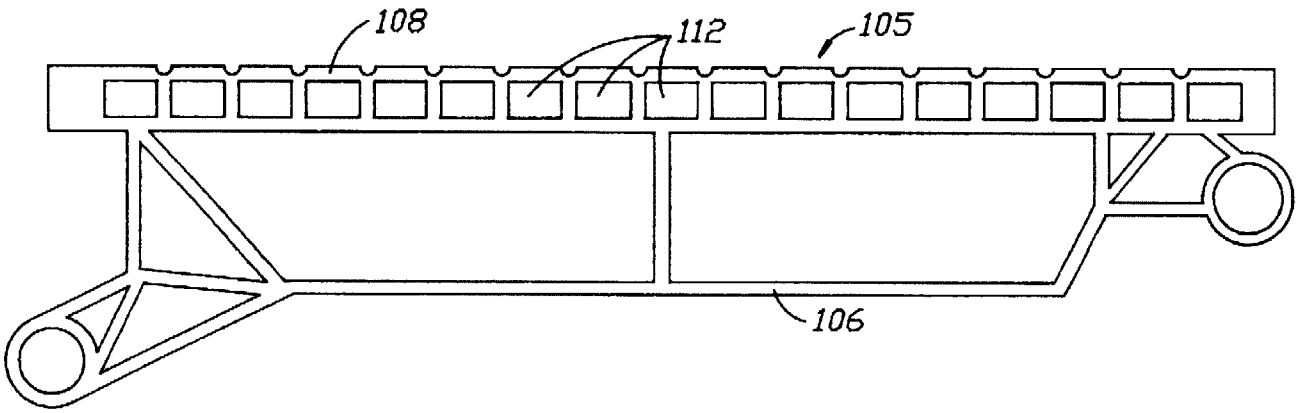
FIG. 5 is a side view of a third embodiment of the pallet according to the present invention.

A third embodiment is shown in FIG. 5. Although illustrated in FIGS. 1–3 as a pallet having a support frame with walls extending widthwise and a separate treadplate, the embodiment in FIG. 5 shows a pallet 105 having a similar support frame 106 and treadplate 108 that is formed integrally therewith. In this configuration, the treadplate 108 is formed by extruding a plurality of hollow channels 112 in the width dimension. The hollow channels 112 minimize the weight of the pallet 105. The cleats 114 in the treadplate 108 are then formed by machining out the desired grooves in the length direction.

Figure 6:
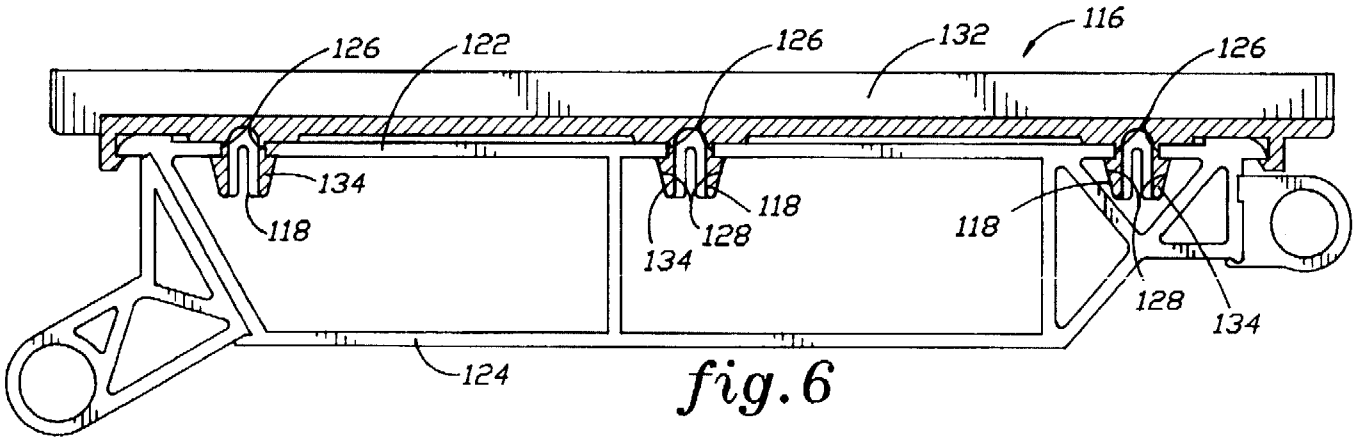
FIG. 6 is a side view of a fourth embodiment of the pallet according to the present invention.

A fourth embodiment is illustrated in FIG. 6. In this configuration, the pallet 116 includes three slots 118 integrally formed in the upper surface 122 of the support frame 124. Each of the slots 118 includes a narrow opening 126 and an expanded section 128. The treadplate 132 includes three projections 134 that extend widthwise along the underside of the treadplate 132. The projections 134 have shapes complementary to the slots 118 such that the projections 134 may be engaged with the slots 118 by sliding the projections 134 laterally within the slots 118. This engagement defines means to removably attach the treadplates 132 to the support frame 124. The embodiment of FIG. 6 has the advantage of being able to easily interchange different types of similar sized treadplates with the same support frames. As a result, the treadplates of an installed passenger conveyor may be changed without requiring replacement of the entire pallet assembly.

Although the invention has been shown and described with respect to exemplary embodiments thereof, it should be understood by those skilled in the art that various changes, omissions, and additions may be made thereto, without departing from the spirit and scope of the invention.

What is claimed is:

1. A pallet for a passenger conveyor, the passenger conveyor including a pallet assembly having a plurality of sequentially connected pallets and a pair of pallet chains having a plurality of axles extending therefrom, the pallet including:

a support structure defining means to carry the forces generated by the passengers on the passenger conveyor, the support structure having a plurality of integrally formed, thin walls forming a profile with all the walls extending in the same principle direction;

means to engage the pallet with an adjacent pallet in the pallet assembly; and means to engage the pallet with the pallet chains, wherein the means to engage the pallet with the pallet chains includes a first air of yokes each of which extends from opposite sides of the forward edge of the pallet and is engageable with one of the axles, the yokes being fastened to the support structure.

2. The pallet according to claim 1, wherein the support structure is formed by an extrusion process whereby the support structure is extruded in the principle direction of the walls.

3. The pallet according to claim 1, wherein the means to engage the pallet with an adjacent pallet includes a second pair of yokes, each which extends from opposite sides of the aft edge of the pallet and is engageable with a pin engaged with a link, the link being connected to the axle engaged with one of the yokes of the adjacent pallet.

4. The pallet according to claim 2, wherein the support structure further includes an integral treadplate having a cleated surface.

5. The pallet according to claim 1, wherein the pallet has a width dimension measured normal to the pallet chains and a length dimension measured in the direction of the pallet chains, and wherein the principle direction of the walls of the support structure is in the width dimension.

6. The pallet according to claim 1, wherein the pallet has a width dimension measured normal to the pallet chains and a length dimension measured in the direction of the pallet chains, and wherein the principle direction of the walls of the support structure is in the length dimension.

7. The pallet according to claim 6, wherein the support structure is formed from a plurality of mating pieces.

8. The pallet according to claim-7, wherein the plurality of mating pieces includes a pair of mating pieces having mirror image profiles.

9. The pallet according to claim 8, wherein the plurality of mating pieces further includes a third mating piece having means to engage each of the pair of mating pieces having mirror image profiles.

10. The pallet according to claim 1, further including a treadplate defining a contact surface for passengers, wherein the support structure includes means to detachably retain the treadplate.

11. A pallet for a passenger conveyor, the passenger conveyor including a pallet assembly having a plurality of sequentially connected pallets and a pair of pallet chains, wherein the pallet has a width dimension measured normal to the pallet chains and a length dimension measured in the direction of the pallet chains, the pallet including:

a support structure defining means to carry the forces generated by the passengers on the passenger conveyor, the support structure having a plurality of integrally formed, thin walls forming a profile with all the walls extending in the same principle direction, and wherein the principle direction of the walls of the support structure is in the width dimension of the pallet;

means to engage the pallet with an adjacent pallet in the pallet assembly; and means to engage the pallet with the pallet chain.

12. The pallet according to claim 11, wherein the support structure is formed by an extrusion process whereby the support structure is extruded in the principle direction of the walls.

13. The pallet according to claim 12, wherein the support structure further includes an integral treadplate having a cleated surface.

14. The pallet according to claim 11, further including a treadplate defining a contact surface for passengers, wherein the support structure includes means to detachably retain the treadplate.

15. A pallet for a passenger conveyor, the passenger conveyor including a pallet assembly having a plurality of sequentially connected pallets and a pair of pallet chains, wherein the pallet has a width dimension measured normal to the pallet chains and a length dimension measured in the direction of the pallet chains, the pallet including:

a support structure defining means to carry the forces generated by the passengers on the passenger conveyor, wherein the support structure is formed from a plurality of mating pieces having a plurality of integrally formed, thin walls forming a profile with all the walls extending in the same principle direction, wherein the principle direction of the walls of the support structure is in the length dimension of the pallet, the support structure including fastener means to attach the mating pieces together;

means to engage the pallet with an adjacent pallet in the pallet assembly; and means to engage the pallet with the pallet chain.

16. The pallet according to claim 15, wherein the mating pieces are formed by an extrusion process whereby the support structure is extruded in the principle direction of the walls.

17. The pallet according to claim 16, wherein the mating pieces further include an integral treadplate having a cleated surface.

18. The pallet according to claim 15, wherein the plurality of mating pieces includes a pair of mating pieces having mirror image profiles.

19. The pallet according to claim 18, wherein the plurality of mating pieces further includes a third mating piece having means to engage each of the pair of mating pieces having mirror image profiles.

20. The pallet according to claim 15, further including a treadplate defining a contact surface for passengers, wherein the support structure includes means to detachably retain the treadplate.

* * * * *